US005738015A

United States Patent [19]

Kusch et al.

[11] Patent Number: 5,738,015

[45] Date of Patent: Apr. 14, 1998

[54] DEVICE FOR GUIDING A PRINT CARRIER

[75] Inventors: Hans-Jürgen Kusch, Neckargemünd; Rudi Stellberger, Kronau; Bernd Ruf, Weiterstadt, all of Germany

[73] Assignee: Heidelberger Druckmaschinen AG, Heidelberg, Germany

[21] Appl. No.: 772,975

[22] Filed: Dec. 23, 1996

Related U.S. Application Data

[63] Continuation of Ser. No. 429,314, Apr. 26, 1995, abandoned.

[30] Foreign Application Priority Data

Apr. 26, 1994 [DE] Germany ..... 44 14 443.1

[51] Int. Cl.[6] ..... B41F 21/00

[52] U.S. Cl. ..... 101/477; 101/415.1

[58] Field of Search ..... 101/378, 382.1, 101/415.1, 477, 212, 216

[56] References Cited

U.S. PATENT DOCUMENTS

| | | | |
|---|---|---|---|
| 5,111,744 | 5/1992 | Wieland | 101/216 |
| 5,127,328 | 7/1992 | Wieland | 101/415.1 |
| 5,218,907 | 6/1993 | Komori et al. | 101/477 |
| 5,259,314 | 11/1993 | Sugiyama | 101/477 |
| 5,289,775 | 3/1994 | Spiegel et al. | 101/477 |
| 5,293,820 | 3/1994 | Maejima et al. | 101/415.1 |
| 5,309,832 | 5/1994 | Merkel et al. . | |
| 5,361,699 | 11/1994 | Comfera | 101/477 |
| 5,363,764 | 11/1994 | Horiguchi et al. | 101/485 |
| 5,454,317 | 10/1995 | Kobler et al. | 101/477 |

FOREIGN PATENT DOCUMENTS

| | | | |
|---|---|---|---|
| 2 337 296 | 2/1974 | Germany . | |
| 89 15 693.5 | 4/1991 | Germany . | |
| 39 40 795 | 9/1991 | Germany . | |
| 62-169646 | 7/1987 | Japan . | |
| 62-169647 | 7/1987 | Japan . | |
| 1-176558 | 7/1989 | Japan . | |
| 4006632 | 3/1994 | WIPO | 101/415.1 |
| 94/06630 | 3/1994 | WIPO . | |

*Primary Examiner*—Ren Yan

*Attorney, Agent, or Firm*—Herbert L. Lerner; Laurence A. Greenberg

[57] ABSTRACT

Device for guiding a print carrier while the print carrier is respectively fed to and removed from a plate cylinder of a printing press includes a pair of guide elements arranged in parallel with the axis of the plate cylinder, and a setting mechanism for positioning the guide elements, the guide elements being formed, respectively, of at least one segment, one of the guide elements, during feeding of a print carrier to the plate cylinder, and another of the guide elements, during removal of the print carrier, being in engagement with the respective print carrier.

9 Claims, 11 Drawing Sheets

DEVICE FOR GUIDING A PRINT CARRIER

This application is a continuation of application Ser. No. 08/429,314, filed on Apr. 26, 1995, now abandoned.

BACKGROUND OF THE INVENTION

Field of the Invention

The invention relates to a device for guiding a print carrier while the print carrier is being fed to and removed from a plate cylinder of a printing press.

In the printing press sector, many attempts have been made to meet the demands to the greatest extent for rationalizing that, on the one hand, printing speeds are increased and, on the other hand, make-ready times are minimized. For example, a plate change in a printing press, when it has to be performed manually by the pressman, is a rather time-consuming process. Therefore, automation of the plate change (removing the old plate and mounting a new plate on each plate cylinder of the printing press) will result in a considerable saving of time. Automatic plate change is especially important, if print orders have to be filled for a small amount of copies to be produced, which requires frequent plate change. In the published German Patent Document DE 41 30 359 A1, there is described a device for automatic plate change.

SUMMARY OF THE INVENTION

Starting from the state of the art, it is an object of the invention of the instant application to provide a device for guiding a print carrier and, more particularly, for providing such a device which enables a reliable feeding and removing of a print carrier to and from a plate cylinder, respectively.

With the foregoing and other objects in view, there is provided, in accordance with the invention, a device for guiding a print carrier while the print carrier is respectively fed to and removed from a plate cylinder of a printing press, the device comprising a pair of guide elements arranged in parallel with the axis of the plate cylinder, and a setting mechanism for positioning the guide elements, the guide elements being formed, respectively, of at least one segment, one of the guide elements, during feeding of a print carrier to the plate cylinder, and another of the guide elements, during removal of the print carrier, being in engagement with the respective print carrier.

In accordance with another feature of the invention, the guide elements are formed as a roller pair.

In accordance with a further feature of the invention, the guide elements are constructed as roller-shaped segments or skids.

In accordance with an added feature of the invention, the guide elements are disposed eccentrically on a traverse. In accordance with an additional feature of the invention, the setting mechanism comprises a traverse, two friction wheels rotatably mounted on the traverse, free-wheeling mechanisms respectively assigned to the friction wheels and having opposite entraining directions, at least one swivelable lever whereon the traverse is mounted, and a cam control for pressing the friction wheels onto Schmitz rings or cylinder bearers of the plate cylinder during a respective feeding and removing of the print carrier.

In accordance with yet another feature of the invention, the device includes a lever connected to the traverse, and an adjusting element for actuating the lever.

In accordance with yet a further feature of the invention, the adjusting element is one of an adjusting cylinder having two operating positions, a magnet and an electric motor.

In accordance with yet an added feature of the invention, the device includes another swivelable lever, the traverse being rigidly connected to the one and the other swivelable lever, and at least one guide element fixed on the traverse.

In accordance with a concomitant feature of the invention, the device includes a swivelably mounted printing-unit safeguard, the guide elements for the print carrier being fastened to the printing-unit safeguard. Thus, by means of the device according to the invention, a problem free guidance of the print carrier during a plate change is achieved. Two guide elements, which may respectively be formed of one or more segments, by their down-holding action, ensure that the surface of the print carrier does not come in contact with machine parts, and damage to the sensitive print surface is effectively prevented thereby. Because the device is constructed in a manner that only one of the two guide elements comes into contact with the surface of the ink-free print carrier (printing plate, printing foil) yet to be printed with, and the other guide element only comes in contact with the surface of the inked print carrier already printed with, soiling of a print carrier not yet printed with is impossible from the start.

According to an advantageous development of the device according to the invention, the two guide elements are constructed as a pair of rollers. For certain embodiments of the invention, it may be advantageous or even necessary to use guides which are constructed as roller or disk-shaped segments or skids in place of continuous rollers. Such constructions could be produced more economically, for once, and additionally, they could prove to be more suitable or even necessary, in order to avoid collision with the grippers of the clamping bar of the clamping and lock-up devices. According to a further development of the device of the invention, the guide elements, however they may be constructed, are eccentrically arranged on a traverse. Through this off-center arrangement of the guide elements and in dependence upon the swiveled position of the traverse, only the desired guide element will come into contact with the surface of the print carrier.

For the swiveling movement of the traverse, a low-cost embodiment of the device according to the invention provides an actuating mechanism described as follows: On the end parts of the traverse, two friction wheels are mounted. A free-wheeling mechanism is associated with or assigned to each friction wheel, one of the free-wheeling mechanisms having an entraining or driving or lock-in direction opposite to that of the other. The traverse itself is resiliently supported on a swivelably mounted lever. While a print carrier is fed or removed, the friction wheels are pressed against Schmitz rings or cylinder bearers of the printing press by cam control. When feeding or removing the print carrier, the traverse and the two guide elements are automatically brought into the desired positions thereof in accordance with the entraining or driving or lock-in directions of the free-wheeling mechanisms which correspond with the direction of rotation of the plate cylinder. Equivalent constructions for positioning the traverse, in accordance with advantageous further embodiments of the invention, are proposed by providing that a lever be fastened to the traverse and be movable via an actuating device, such as an actuating cylinder with two operating positions, a motor or a magnet, for example.

In another advantageous embodiment of the device according to the invention, another traverse is provided between swivelable levers, with at least one guide element being fixed to the traverse. Alternatively, the guide element is rigidly fastened to a feeding table. The guide element ensures a save removal of the plate onto the feed table. Preferably, the guide elements are arranged in a space between the grippers of the clamping bars.

Furthermore, it has been proven to be advantageous to fasten the device for the feeding and removing of print carriers to a swivelably mounted safeguard of the printing press. The device can then be removed together with the safeguard, which becomes necessary automatically when work has to be performed on the rollers and cylinders of the printing unit.

Other features which are considered as characteristic for the invention are set forth in the appended claims. Although the invention is illustrated and described herein as embodied in a device for guiding a print carrier, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

FIG. 2 showing the guide roller pair in a position after a leading edge of a plate has been inserted into a clamping device (position B); FIG. 3 showing the guide roller pair in a position shortly before a trailing edge of the plate is clamped in a clamping and lock-up device; FIG. 4 showing the guide roller pair in a position when the trailing edge of the plate is released from the clamping and lock-up device (position A); and FIG. 5 showing the guide roller pair in a position when the plate is removed;

DESCRIPTION OF THE PREFERRED EMBODIMENTS

Figure 1:
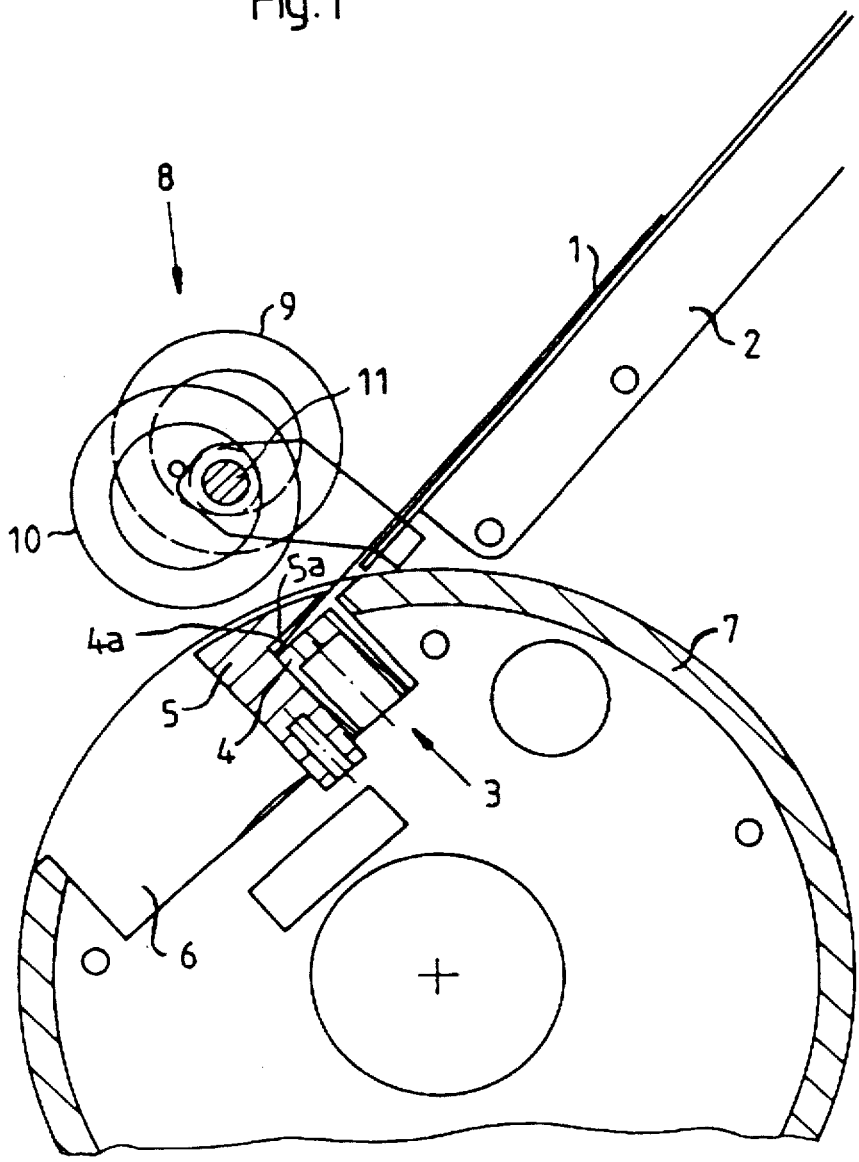
FIGS. 1 and 2 are smaller-scale and FIGS. 3, 4 and 5 are larger-scale diagrammatic and schematic sectional views of the device for guiding a print carrier according to the invention, in various different phases of operation thereof, when in the two operating positions thereof for supplying and removing printing plates, respectively, FIG. 1 showing a guide roller pair in a starting position thereof (position A)

Referring now to the drawings and, first, particularly to FIGS. 1 to 5 thereof, there is shown therein an advantageous embodiment of the device for the feeding and removing of print carriers in both operating positions, namely the position A and the position B, thereof. The embodiments for controlling the two different positions A and B are described hereinafter.

FIG. 1 shows the position of the guide roller pair 8 at a point in time when a print carrier 1 (printing plate or printing foil), moved over a feeding table 2, is placed between clamping surfaces 4*a* and 5*a* of two clamping bars 4 and 5, respectively, of a leading edge clamping device 3. Clamping of the leading edge of the printing plate 1 takes place when one of the two clamping surfaces 4*a* and 5*a* is moved in a direction perpendicularly to the respective other clamping surface 4*a*, 5*a*. In a conventional manner, the clamping device 3 is arranged in a cylinder gap 6 of a plate cylinder 7 of an otherwise non-illustrated printing press. In this position A which is defined as a starting position, the guide roller pair 8, formed of two guide rollers 9 and 10, is disengaged from the surface of the plate cylinder 7. Both of the guide rollers 9 and 10 are mounted eccentrically on a swivelably mounted traverse 11.

Figure 2:
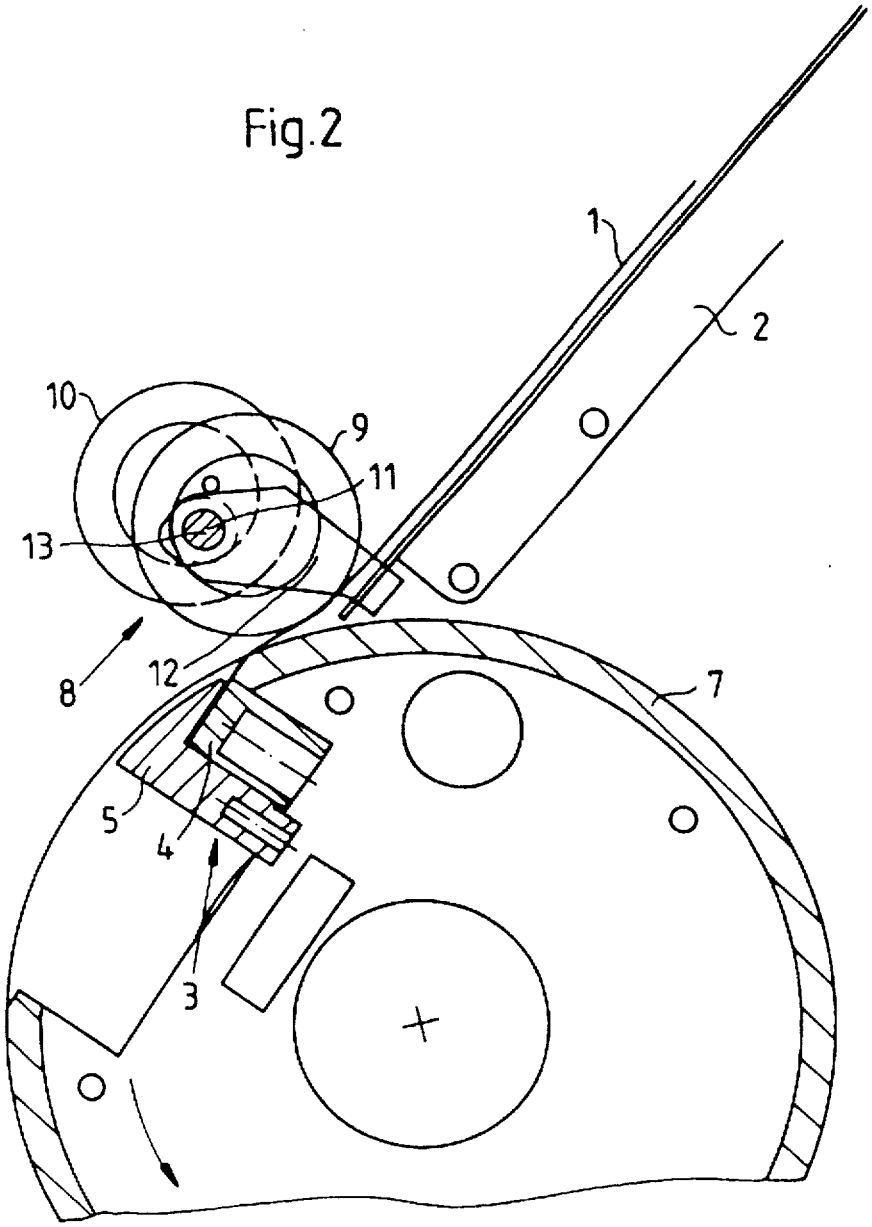
Figure 3:
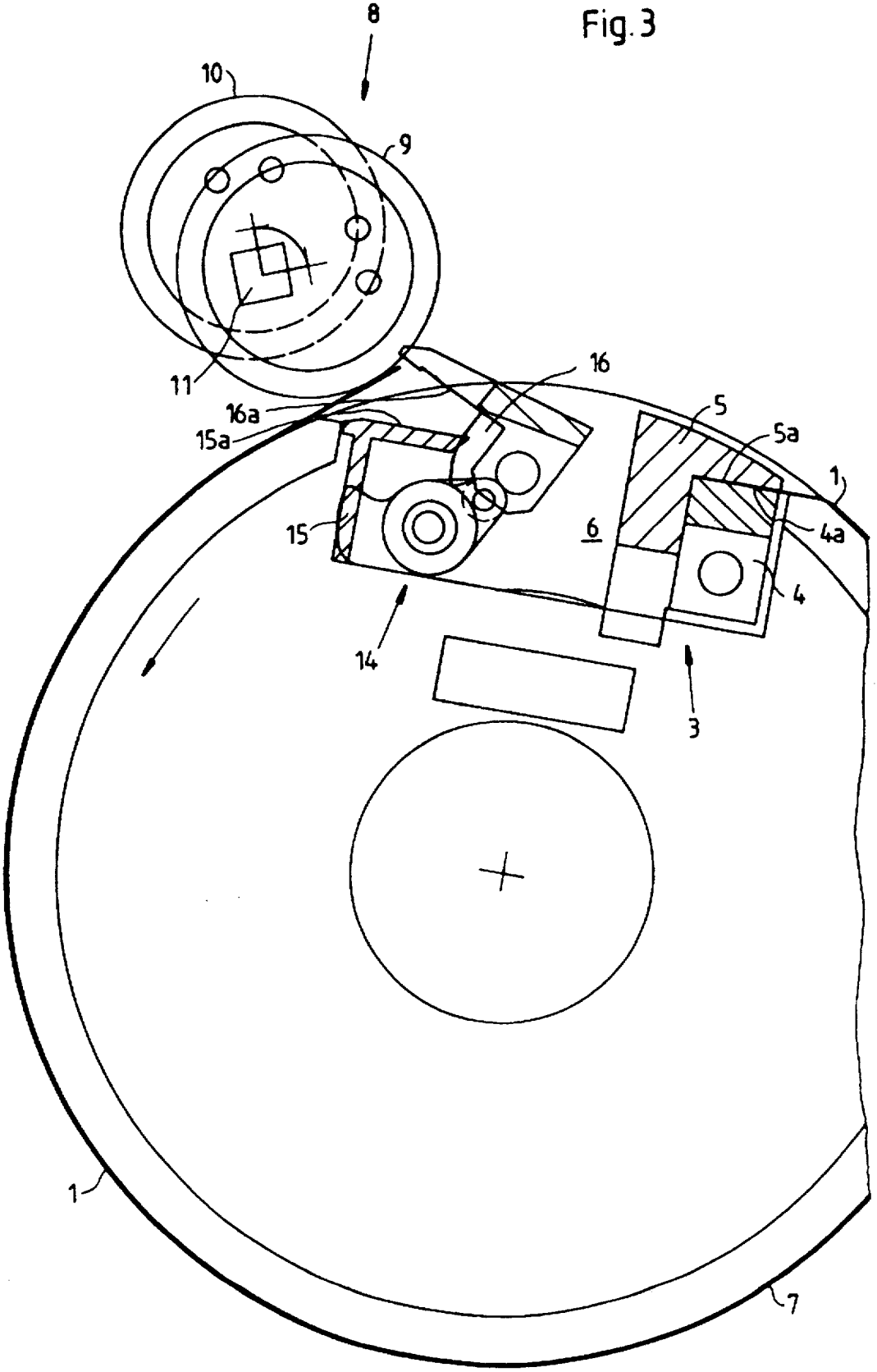

FIGS. 2 and 3 show the positions of the guide roller pair 8 during the mounting of the printing plate 1 on the plate cylinder 7 (position B). Due to a swinging or swiveling movement of the traverse 11, the guide roller pair 8 moves into the position B which is at a defined distance from the plate cylinder 7. The guide roller 9 holds the plate 1 down while the plate cylinder 7 rotates about the central axis thereof in the direction indicated by the curved arrow.

As is apparent from FIG. 3, the guide roller pair 8 remains in this position, until the trailing edge of the printing plate 1, after one revolution of the plate cylinder 7, is fixed between the clamping surfaces 15*a* and 16*a* of the clamping bars 15 and 16, respectively, of the trailing-edge clamping and lock-up device 14. Clamping and lock-up devices for printing plates 1 have become well known heretofore. To obtain descriptions of some suitable constructions for such devices, reference may be had to the published German Patent Documents DE 41 28 994 A1 and DE 41 29 831 A1. In order to ensure that the leading edge of the plate is securely inserted into the clamping device, a guide element 18 which is a part of the feeding table 2 is provided.

Figure 4:
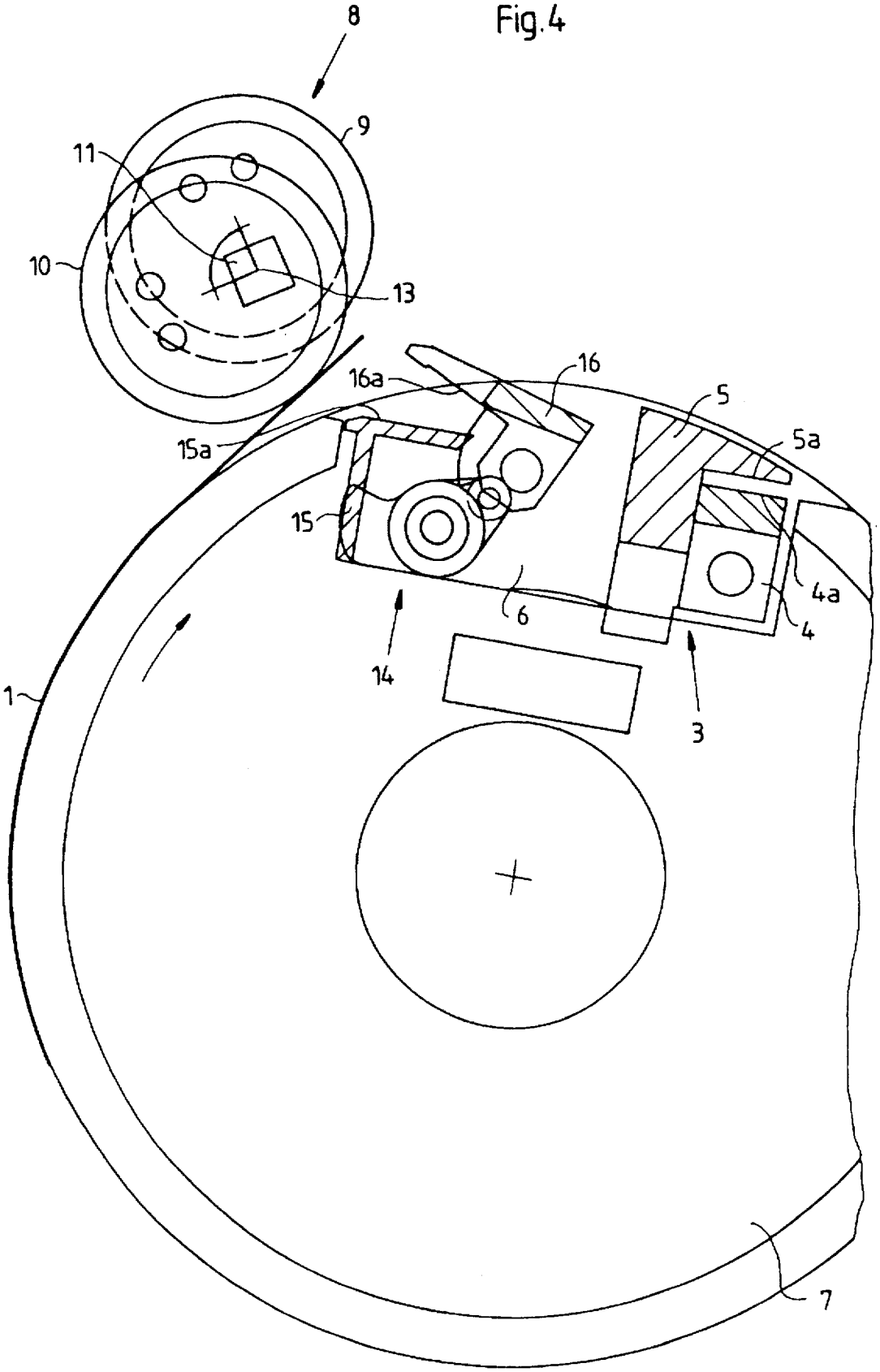
Figure 5:
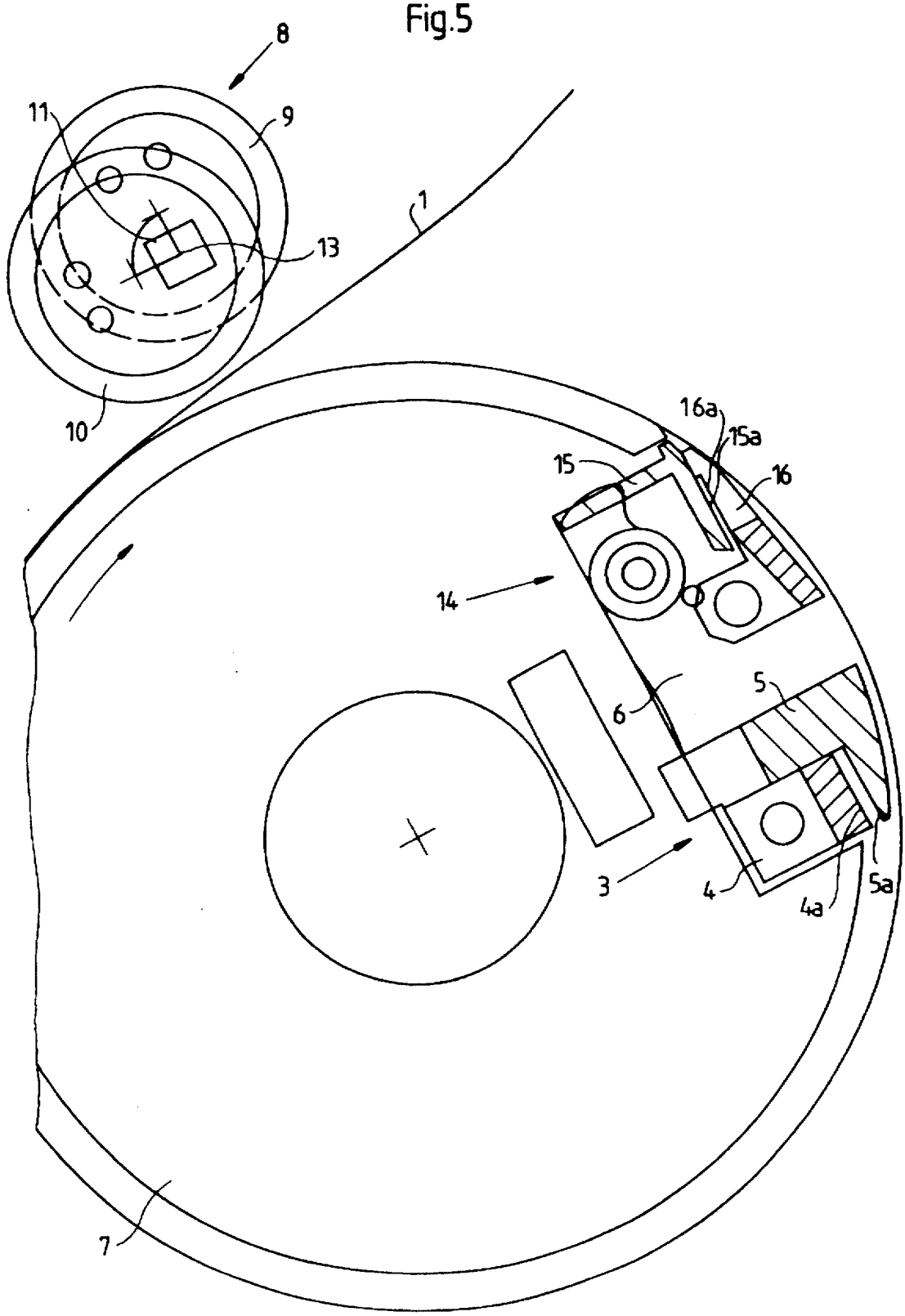

To remove the printing plate 1 from the plate cylinder 7, the guide roller pair 8 is moved into the second position thereof, namely the position A. The instant the clamping and lock-up device 14 releases the trailing edge of the plate 1, the latter jumps out of its mounting support due to its own tension and comes in contact with the surface of the guide roller 10. During the revolving of the plate cylinder 7 and the unwinding of the printing plate 1 therewith, the latter is moved past the guide roller 10 and onto the feeding table 2. Guide elements 18 support the "ejection" of the printing plate 1 in an advantageous way. This process is illustrated in FIGS. 4 and 5 of the drawings.

Figure 6:
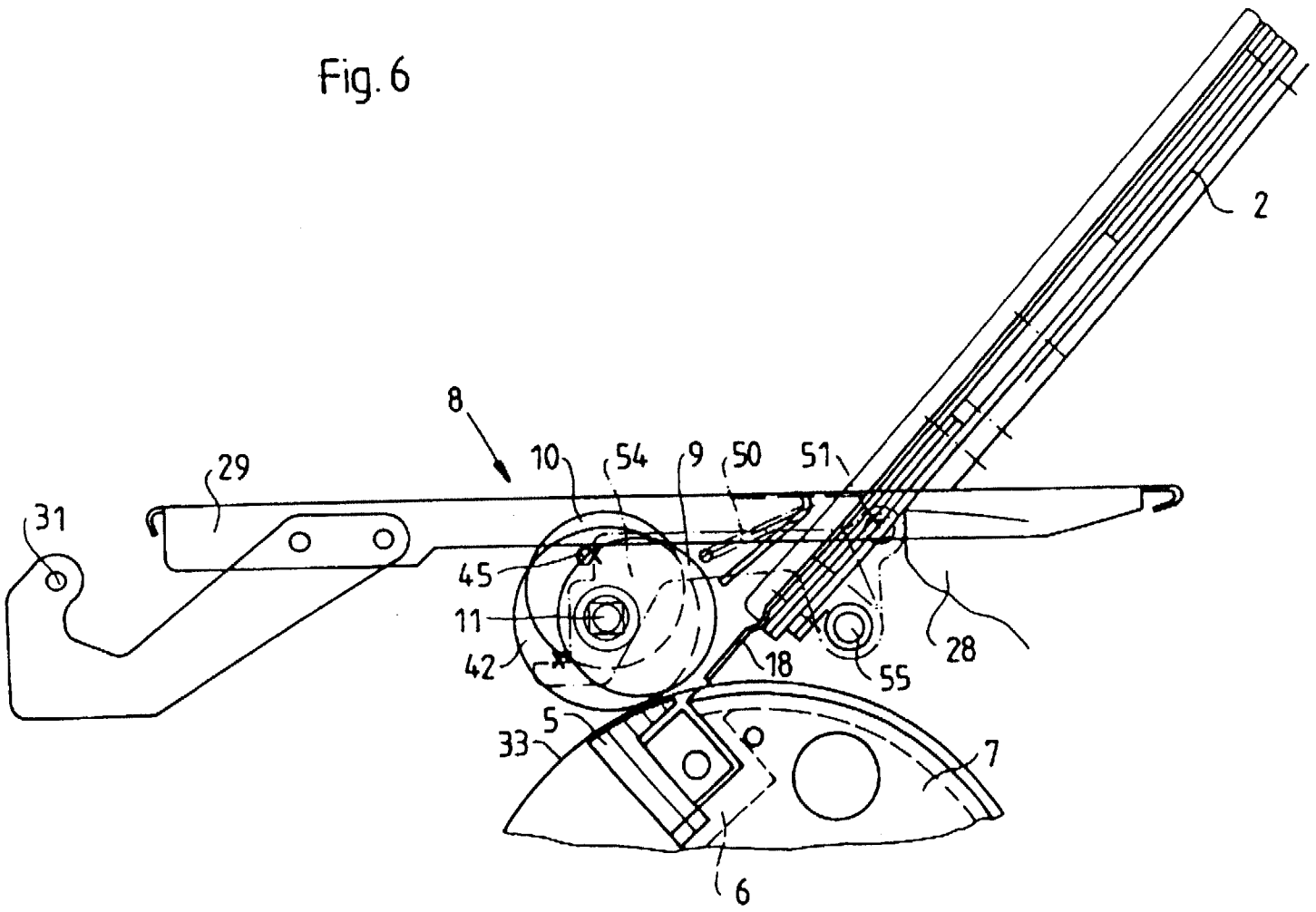
FIG. 6 is a diagrammatic and schematic side elevational view of the guide roller pair with a first embodiment of an engagement and disengagement mechanism constructed in accordance with the invention.
Figure 7:
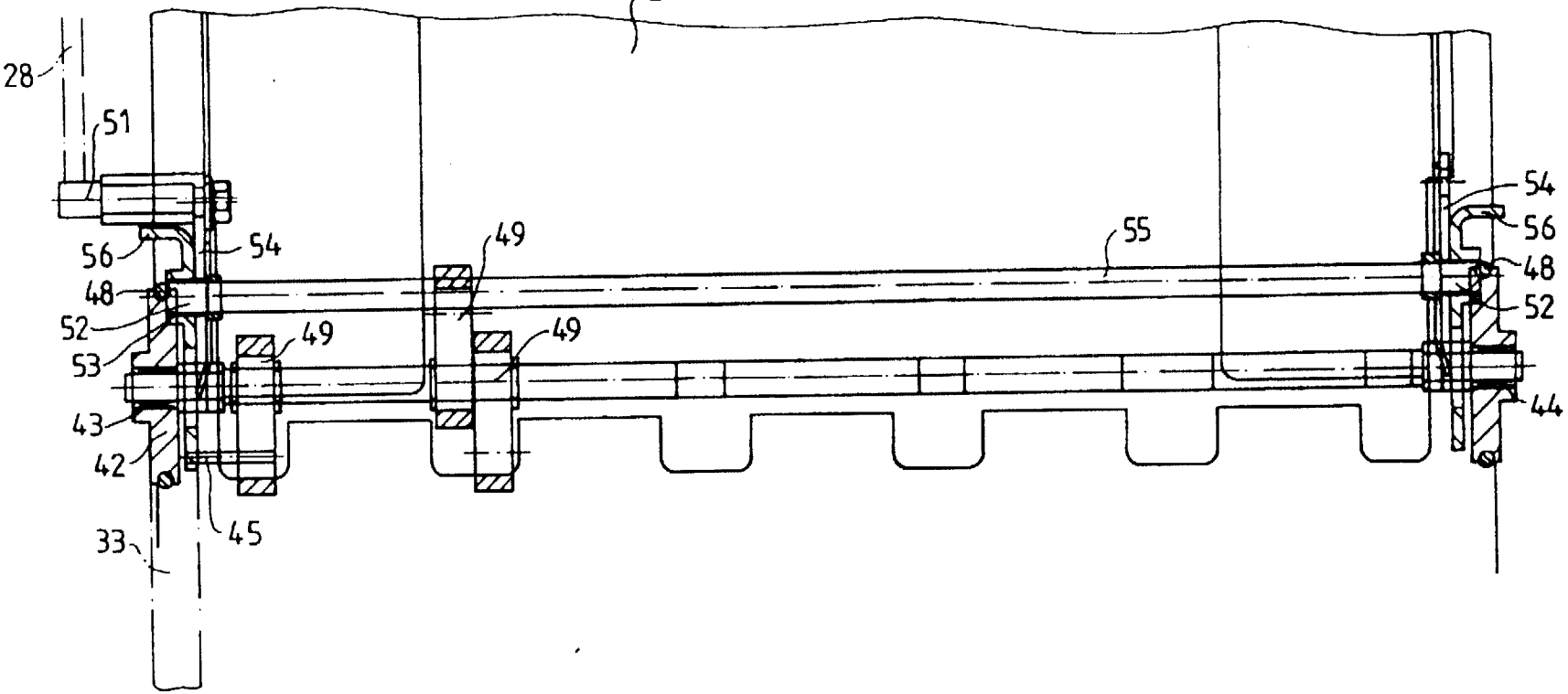
FIG. 7 is a top plan view of FIG. 6.

FIG. 6 is a side elevational view of the guide roller pair 8 together with a first embodiment of an engagement and disengagement mechanism; FIG. 7 is a front elevational view of FIG. 6. The guide rollers 9 and 10 are rigidly fixed on a turnably mounted traverse 11 which, in the illustrated embodiment, is formed as a square bar but may obviously have other cross sections. Both guide rollers 9 and 10 are formed of eccentrically mounted disk-shaped segments 49, which are arranged in a manner that both positions (position A and position B) of the guide rollers 9 and 10 can be attained by turning the traverse 11 a given angle. The spaced distance between the disk-shaped segments 49 is such that a collision with the clamping bars 4 and 15 of the clamping and lock-up device 3, 14 on the plate cylinder 7 is impossible.

The end regions 52 of the traverse 11 are turnably mounted via bushings 53 in guide levers 54 which are arranged on both sides. The end regions 52 of the traverse 11 carry friction wheels 42. Each friction wheel 42 is associated with a free-wheel mechanism 43, 44 at the drive side and at the operator's side, the free-wheels having mutually opposite entraining directions. A shaft 55 is rotatably mounted in the guide levers 54 and in fastening parts 56, which are fixedly connected with the printing unit safeguard 29. On the fastening part 56, at the drive side, a bolt or pin 51 is disposed which cooperates with a cam 28. The guide levers 54 carrying the guide roller pair 8 are controlled by the cam 28 so as to turn about the central axis of the shaft 55. This is performed against the force of a tension spring 50.

Due to the turning or swiveling movement of the guide levers 54, the friction wheels 42, which carry a respective rubber ring 48 on the circumference thereof, are pressed onto Schmitz rings or cylinder bearers 33 of the plate cylinder 7. The entraining direction of the free-wheel mechanisms 43, 44 is established so that, when a plate is being drawn in, the guide roller 9 is located close to the printing plate 1, and when a plate is being ejected, the guide roller 10 is located close to the printing plate 1.

Figure 8:
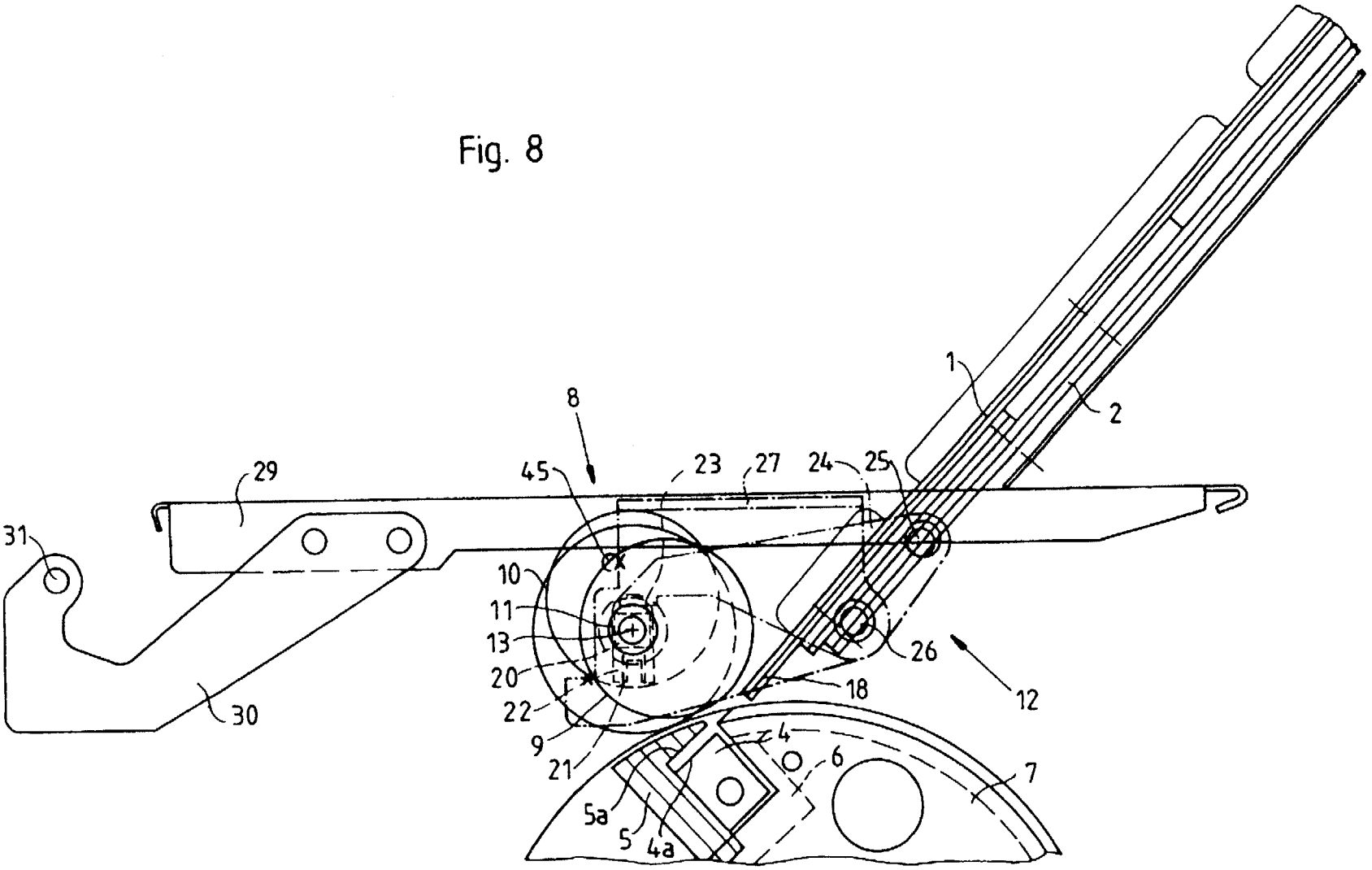
FIG. 8 is an enlarged view like that of FIG. 6 of the guide roller pair with a second embodiment of the engagement and disengagement mechanism.

For the purpose of limiting the turning movement of the traverse 11 and of the guide roller pair 8 mounted thereon, or for locking the drive roller pair 8 in the two end positions (position A and position B), limit pins 45 are disposed on the two outer disk-shaped segments 49 and, in both required angular positions, abut or engage the edges of the correspondingly shaped fastening parts 56. The abutment locations are identified in FIG. 6 by an "x". FIG. 8 is a side elevational view of the drive roller pair 8 according to the invention with another advantageous embodiment of the engagement and disengagement mechanism. The guide rollers 9 and 10, again formed of individual disk-shaped segments 49 in this embodiment, are rigidly fastened on a turnably mounted traverse 11, which has a square cross section but may, of course, as aforementioned, be formed with a different cross section. Because the disk-shaped segments 49 of each of the two guide rollers 9 and 10 are arranged eccentrically, the two desired positions A and B may be set by turning the traverse 11.

The traverse 11 is provided on both sides thereof with bearings 20 which are disposed, respectively, in a slot 21 formed in fastening parts 27 and supported on springs 22. On the resiliently mounted traverse 11 carrying the guide rollers 9 and 10, there is exerted a force which is controlled by a cam 28 for setting the two operating positions A and B of the guide roller pair 8. As is apparent from FIG. 8 and particularly from FIG. 9, friction wheels 42 are rotatably mounted on the traverse 11. The friction wheels 42 carry a respective rubber ring 48 surmounted on the circumference thereof. Another traverse 25 couples the two levers 24 rigidly with one another. When a force is exerted on the two levers 24 and, thereby, on the traverse 11 and the guide rollers 9 and 10 by means of the cam control, the friction wheels 42 are pressed onto the Schmitz rings or cylinder bearers 33 of the plate cylinder 7.

The friction wheels 42, respectively, have a free-wheeling mechanism 43, 44, of which the free-wheeling mechanism 44 at the operator's side has a different entraining direction than that of the free wheeling mechanism 43 at the drive side. The entraining or driving or lock-in direction of the free-wheeling mechanisms 43 and 44 has been selected so that the traverse 11 with the guide rollers 9 and 10, in the case of the plate injection, is swung into the position B and, in the case of the plate ejection, is swung into the position A. To ensure the fixing of the guide roller pair 8 in the selected respective end position, pins 45 are provided at the end faces of the roller 9 or at the end faces of the two outer disk-shaped segments, the pins 45 cooperating with a correspondingly matching shape of the fastening parts 27. The two abutment or engagement locations for the limit pin 45 at the fastening part 27 are respectively marked with an "x" in FIG. 8.

Figure 9:
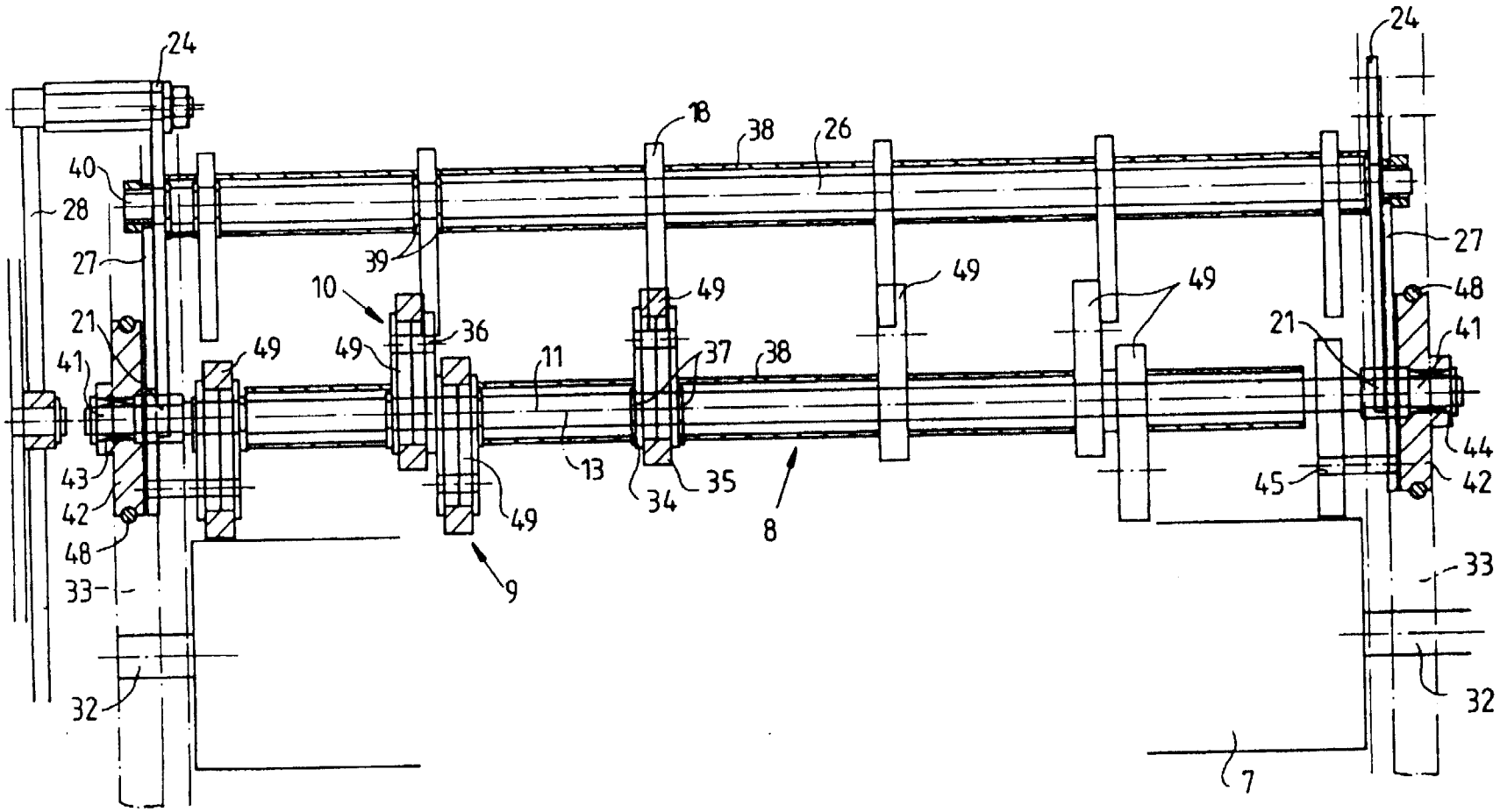
FIG. 9 is a top plan view of FIG. 8.
Figure 10:
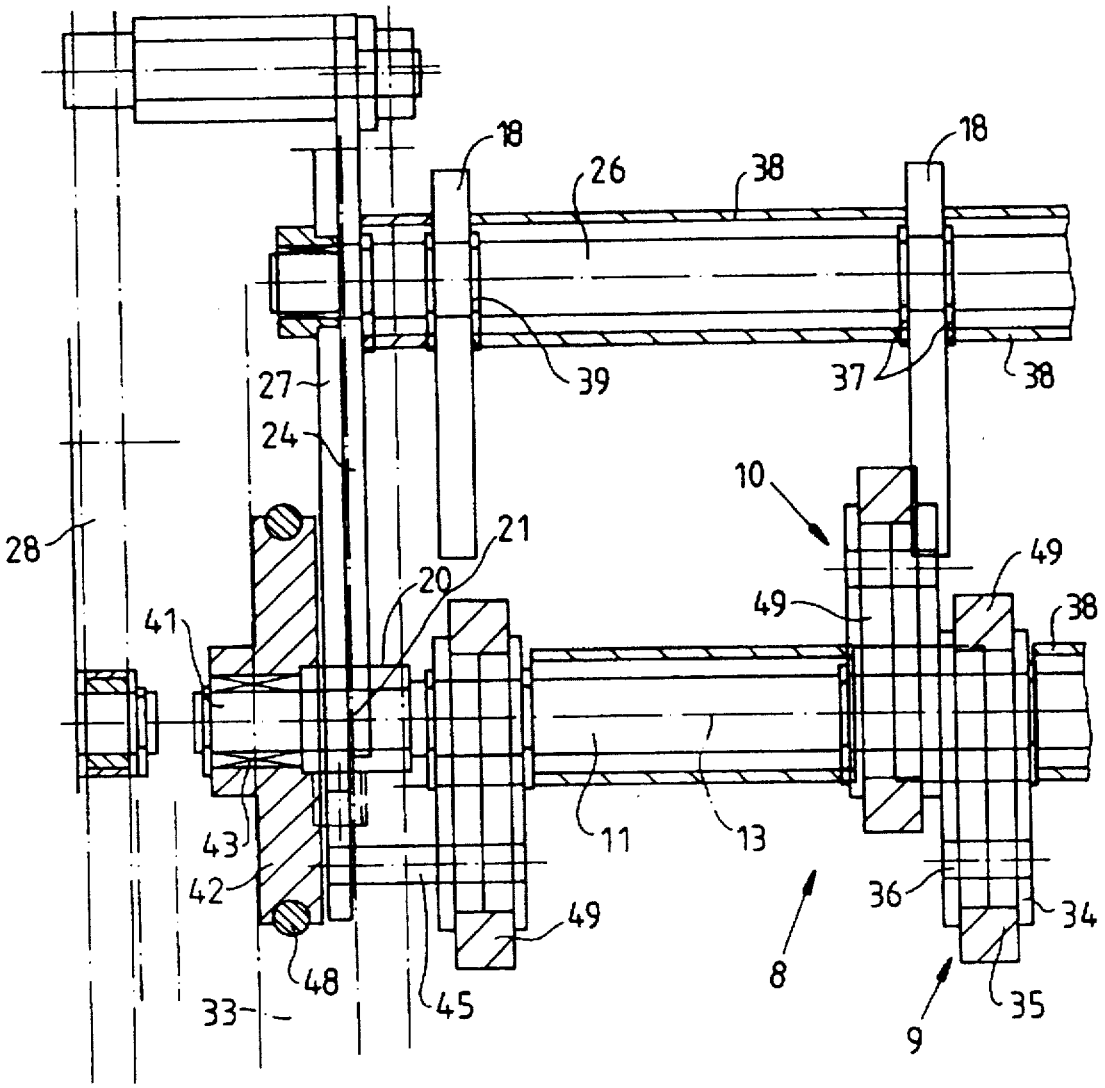
FIG. 10 is an enlarged fragmentary view of FIG. 9.

As can be seen in the side elevational view of FIG. 8 and in the front elevational views of FIGS. 9 and 10, another traverse 26 (square cross section) is rigidly mounted on the levers 24 arranged on both sides. The guide elements 18 are fixedly disposed on this traverse 26 by means of retaining rings arranged on both sides. The traverse 26 with the guide elements 18 performs the swinging or swiveling movement of the lever 24 together with the latter, due to the rigid connection therebetween. The guide elements 18 are arranged on the traverse 26 in such a manner that they do not collide with the clamping bars 4, 5, 15, 16 of the clamping and lock-up devices 3, 14 for the leading and trailing edges of the plate 1.

The disk-shaped segments 49 shown in FIGS. 9 and 10 are formed of symmetrically shaped, disk-like parts 34 which are held together by means of a pin 36 and through the intermediary of retaining rings 37 and, in addition, are eccentrically fixed on the traverse 11 by means of the retaining rings 37. A ring 35 is turnably mounted in a recess of the disk-like parts 34 extending in the circumferential direction thereof. The instant the printing plate 1 comes into contact with the circumferential surface of the rings 35 of the respective engaged disk-shaped segments 49, the rings 35 roll off on the printing plate 1.

As shown in FIG. 8, the device for the feeding and ejecting of a printing plate 1 is screwed to the printing unit safeguard 29 via the angle-shaped fastening parts 27 arranged on both sides. In the interest of clarity, these fastening parts 27 are omitted in the top plan views of FIGS. 9 and 10. The printing unit safeguard 29 is screwed to a lever 30 which is mounted so as to be swingable about an axis 31. In order to perform any work on the printing unit, the pressman or other operator has to raise the safeguard 29. With the construction which has been selected, the plate feeding device is moved away simultaneously with the safeguard 29, in an advantageous manner, so that free access to the printing unit, for example for cleaning purposes, is achieved thereby.

Figure 11:
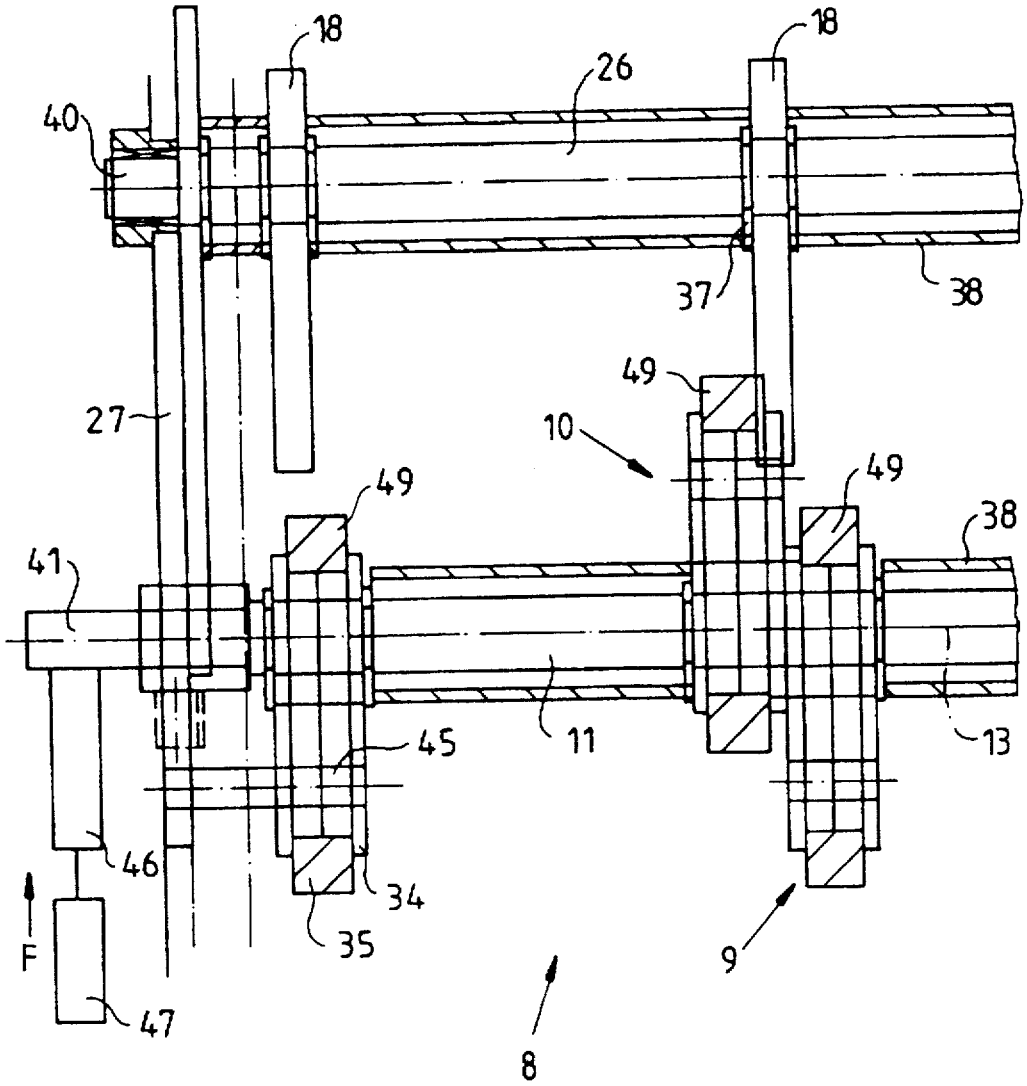
FIG. 11 is a sectional view of the guide roller pair according to a third embodiment of the engagement and disengagement mechanism.

FIG. 11 shows a further engagement and disengagement mechanism for the guide roller pair 8. With the exception of this mechanism, all components are identical with those of FIG. 9 and FIG. 10, respectively. In order that the traverse 11 be able to perform the swinging movement, a lever 46 is coupled to a pin 41 at one end of the traverse 11. The lever 46 is associated with an actuating device 47 which applies a force F to the lever 46 so as to effect the necessary settings in dependence upon the angular position of the printing press. This actuating device 47 could be, for example, a lifting cylinder with two operating positions, or a magnet. Obviously, an electric motor may also be used instead.

We claim:

1. Device for guiding a print carrier while the print carrier is respectively fed to and removed from a plate cylinder of a printing press, said device comprising:

first and second guide elements arranged in parallel with the axis of said plate cylinder;

a setting mechanism for positioning said guide elements; and said guide elements being formed as rollers, said first guide element, during feeding of a print carrier to the plate cylinder, being set to form a defined guide space between said plate cylinder and said first guide element while said second guide element is set to a non-engaging position and, during removal of the print carrier from said plate cylinder, said second guide element being set to form a defined guide space between said plate cylinder and said second guide element while said first guide element is set to a non-engaging position.

2. Device according to claim 1, further comprising a traverse, said guide elements disposed eccentrically on said traverse.

3. Device according to claim 2, including a lever connected to said traverse, and an adjusting element for actuating said lever.

4. Device according to claim 3, wherein said adjusting element is one of an adjusting cylinder having two operating positions, a magnet and an electric motor.

5. Device according to claim 1, wherein said setting mechanism comprises a traverse, two friction wheels rotatably mounted on said traverse, free-wheeling mechanisms respectively assigned to said friction wheels and having opposite entraining directions, at least one swivelable lever whereon said traverse is mounted, and a cam control for pressing said friction wheels onto Schmitz rings or cylinder bearers of the plate cylinder during a respective feeding and removing of the print carrier.

6. Device according to claim 5, including another swivelable lever, said traverse being rigidly connected to said one and said other swivelable lever, and at least one guide element fixed on said traverse.

7. Device according to claim 1, including a swivelably mounted printing-unit safeguard, said guide elements for the print carrier being fastened to said printing-unit safeguard.

8. Device according to claim 1, wherein said first guide element, during feeding of a print carrier to the plate cylinder, and said second guide element, during removal of the print carrier, are in engagement with the respective print carrier.

9. Device for guiding a print carrier while the print carrier is respectively fed to and removed from a plate cylinder of a printing press, said device comprising:

first and second guide elements arranged in parallel with the axis of said plate cylinder;

a setting mechanism for positioning said guide elements; and said guide elements being formed as roller-shaped segments or skids, said first guide element, during feeding of a print carrier to the plate cylinder, being set to form a defined guide space between said plate cylinder and said first guide element while said second guide element is set to a non-engaging position and, during removal of the print carrier from said plate cylinder, said second guide element being set to form a defined guide space between said plate cylinder and said second guide element while said first guide element is set to a non-engaging position.

* * * * *